US006544075B1

(12) United States Patent
Liao

(10) Patent No.: US 6,544,075 B1
(45) Date of Patent: Apr. 8, 2003

(54) WIRELESS ADAPTER

(75) Inventor: Ming-Kaun Liao, Hsinchu Hsien (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/128,227

(22) Filed: Apr. 24, 2002

(51) Int. Cl.[7] ..... H01R 25/00
(52) U.S. Cl. ..... 439/638; 439/11
(58) Field of Search ..... 439/638, 164, 439/165, 11, 13

(56) References Cited

U.S. PATENT DOCUMENTS 5,403,197 A * 4/1995 Ernst et al. ..... 343/702
5,658,157 A * 8/1997 Koiwa et al. ..... 439/165
6,101,087 A * 8/2000 Sutton et al. ..... 361/683
6,164,989 A * 12/2000 Glad et al. ..... 439/131
6,352,434 B1 * 3/2002 Emmert ..... 439/165
6,394,813 B1 * 5/2002 Stout et al. ..... 439/11

* cited by examiner

*Primary Examiner*—Tho D. Ta
*Assistant Examiner*—Edwin A. León
(74) *Attorney, Agent, or Firm*—Birch, Stewart, Kolasch & Birch, LLP

(57) ABSTRACT

A wireless adapter for an electronic device. The electronic device is provided with a connector, and the wireless adapter includes a connecting assembly, an intermediate assembly, and an antenna. The connecting assembly connects with the connector in a detachable manner. The intermediate assembly connects with the connecting assembly in a rotatable manner. The antenna connects with the intermediate assembly in a rotatable manner.

16 Claims, 9 Drawing Sheets

WIRELESS ADAPTER

BACKGROUND OF THE INVENTION

1. Field of the Invention

The invention relates to a wireless adapter; in particular, to a wireless adapter that is rotatable and foldable.

2. Description of the Related Art

Wireless devices enable computers to communicate with other computer devices without requiring physical access to a land line communication port. One type of wireless device is a wireless adapter that is similar to a wired adapter in that it permits a computer or other device to send and receive data from external sources. A wireless adapter may be installed as an adapter card or in an adapter slot such as a universal serial bus (USB) slot. A wireless adapter typically consists of two major portions: a radio portion and a baseband portion.

The radio portion consists of a transmitter and a receiver. The transmitter and receiver may share a common antenna via a duplexer. The transmitter is responsible for generating RF signals using a baseband signal to modulate a carrier signal. The receiver is responsible for producing a baseband signal from RF signals by demodulating a RF signal received at the antenna to produce a demodulated baseband signal. The radio portion provides physical access to a network or connection (i.e., the wireless network). An antenna is used for transmitting and receiving the electromagnetic communications signals from the air interface.

The baseband portion provides a baseband signal to the transmitter and accepts baseband signals from the radio receiver. The baseband portion decodes the baseband signals to provide data (i.e., receiving data) and encodes data to provide a baseband signal for transmission by the transmitter (i.e., sending data).

As is typical of wireless adapters, a portion of the wireless adapter fits into a USB slot. The adapter may consist of an integrated package or several separate components that can be attached via appropriate cabling. The radio portion of the wireless adapter contains the transmitter, receiver and associated circuitry to provide for RF communications.

Recently, for the convenience of the mobility of the wireless adapter, a foldable wireless adapter has been provided. FIG. 1*a* shows a conventional foldable wireless adapter 10. The wireless adapter 10 comprises a connecting portion 11 and an antenna 12. The connecting portion 11 connects with a connector 21 of an electronic device 20 as shown in FIG. 1*b*. The antenna 12 is used for transmitting and receiving the electromagnetic communications signals from the air interface, and connects with the connecting portion 11 through a shaft 13. By means of the shaft 13, the antenna 12 rotates around the connecting portion 11 to fold up the entire adapter 10.

Since the conventional wireless adapter 10 can be folded up, it is convenient to carry. However, such adapter as 10 is not adapted for all kinds of connectors for electronic devices. For example, when the connector 21 of the electronic device 20 is disposed in a manner as shown in FIG. 1*b*, the wireless adapter 10 can be disposed on the electronic device 20 in a manner such that the antenna l2 of the wireless adapter 10 rotates upwardly. Thus, it does not affect the signal communication. However, when a connector 31 of an electronic device 30 is disposed in a manner as shown in FIG. 1*c*, the wireless adapter 30 can only be disposed on the electronic device 30 in a manner such that the antenna 12 of the wireless adapter 10 rotates rightwards and leftwards. Thus, it could affect the signal communication. As a result, the quality of the signal communication is affected.

SUMMARY OF THE INVENTION

In order to address the disadvantages of the aforementioned wireless adapter, the invention provides a wireless adapter that is rotatable and foldable.

Another purpose of this invention is to provide a wireless adapter that is adapted for all kinds of connectors with different angles.

Still another purpose of this invention is to provide a wireless adapter that can be conveniently applied without affecting its communication quality no matter which angle of the connector of the electronic device is.

Accordingly, the invention provides a wireless adapter for an electronic device. The electronic device is provided with a connector, and the wireless adapter comprises a connecting assembly, an intermediate assembly, and an antenna. The connecting assembly connects with the connector in a detachable manner. The intermediate assembly connects with the connecting assembly in a rotatable manner. The antenna connects with the intermediate assembly in a rotatable manner.

In a preferred embodiment, the intermediate assembly comprises a first base and a second base. The first base holds the connecting assembly. The second base is disposed on the first base in a manner such that the connecting assembly is disposed between the first base and the second base in a rotatable manner. The second base connects with the antenna in a rotatable manner.

Furthermore, the first base is provided with at least one first through hole, and the second base is provided with at least one hook corresponding to the first through hole. Thus, the second base is combined with the first base by the hook engaging with the first through hole.

In another preferred embodiment, the connecting assembly is provided with a rotating member disposed in the intermediate assembly in a rotatable manner.

Furthermore, the rotating member is provided with at least one groove, and the intermediate assembly is provided with at least one stopper. Thus, when the rotating member is located in the intermediate assembly, the stopper is fitted into the groove so that the rotating member rotates within a predetermined range.

Furthermore, the intermediate assembly is provided with a locating member, abutting with the rotating member, for locating the rotating member in the intermediate assembly.

In another preferred embodiment, the wireless adapter further comprises a shaft for connecting the intermediate assembly and the antenna.

Furthermore, the intermediate assembly is provided with at least one second through hole for the shaft passing through.

In another preferred embodiment, the connecting assembly is electrically coupled to the antenna through the intermediate assembly.

In another preferred embodiment, the connector is a USB port, and the connecting assembly is a USB plug.

BRIEF DESCRIPTION OF THE DRAWINGS

The invention is hereinafter described in detail with reference to the accompanying drawings in which.

DETAILED DESCRIPTION OF THE INVENTION

Figure 1A:
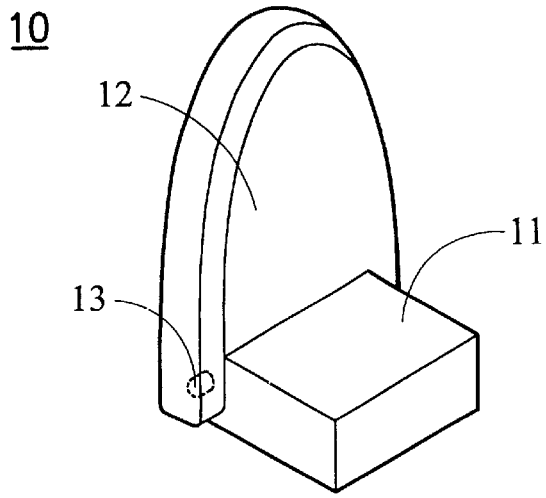
FIG. 1a (PRIOR ART)
FIG. 1*a* is a schematic view depicting a conventional foldable wireless adapter.
Figure 1B:
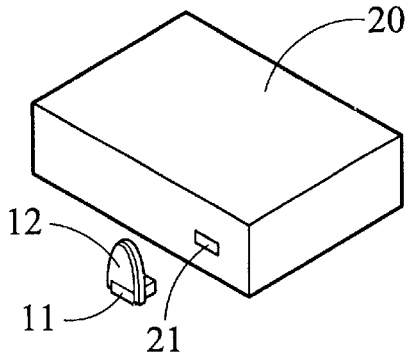
FIG. 1b (PRIOR ART)
FIG. 1*b* and FIG. 1*c* are schematic views depicting the relationship between the wireless adapter, as shown in FIG. 1*a,* and connectors with different positions.
Figure 1C:
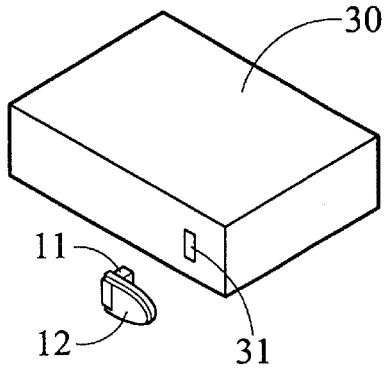
FIG. 1c (PRIOR ART)
Figure 2:
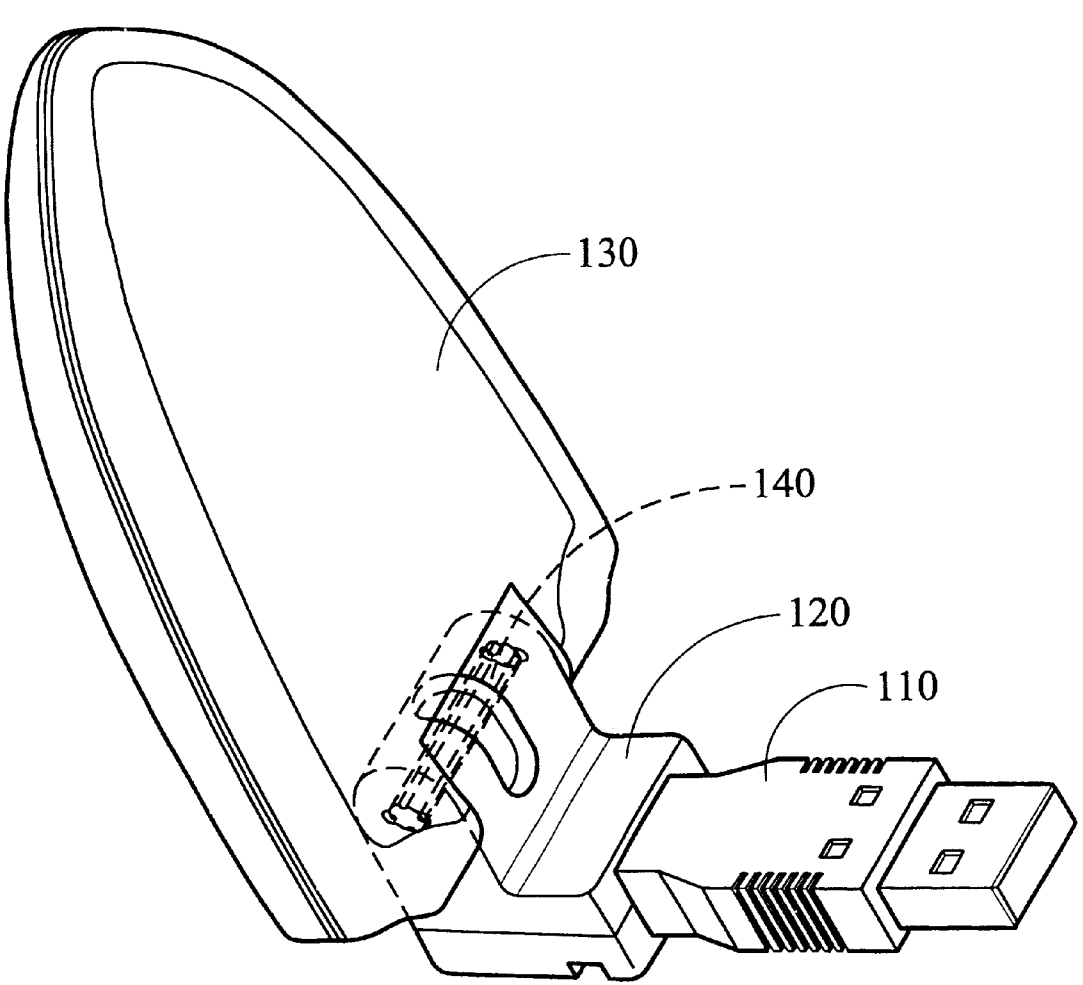
FIG. 2 is a three dimensional diagram depicting a wireless adapter as disclosed in this invention.

Referring to FIG. 2, a wireless adapter 100 as disclosed in this invention is applied for the electronic devices 20, 30 as shown in FIG. 1*b* and FIG. 1*c.* The wireless adapter 100 comprises a connecting assembly 110, an intermediate assembly 120, an antenna 130, and a shaft 140.

Figure 3A:
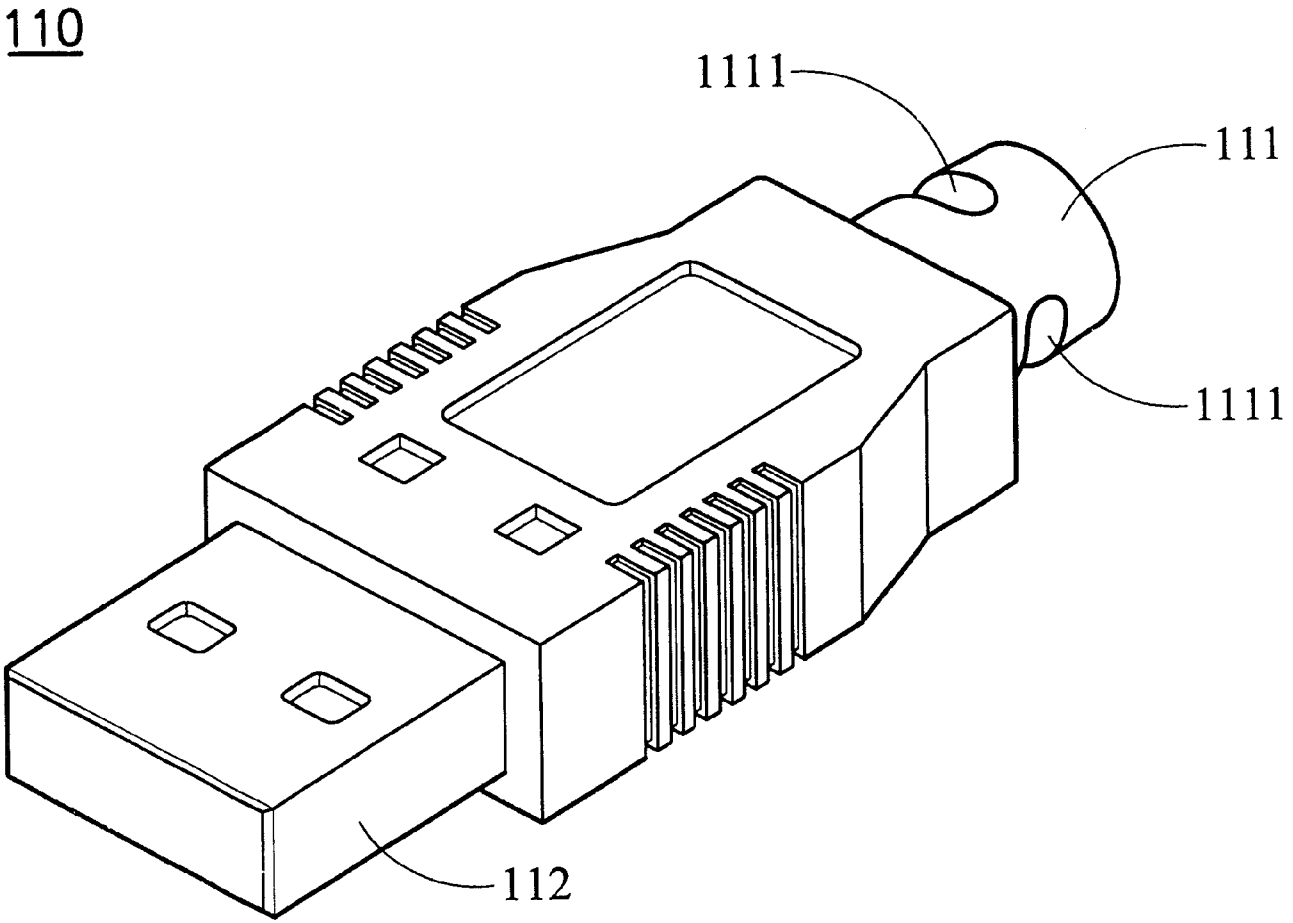
FIG. 3*a* is a three dimensional diagram depicting a connecting assembly in FIG. 2.
Figure 3B:
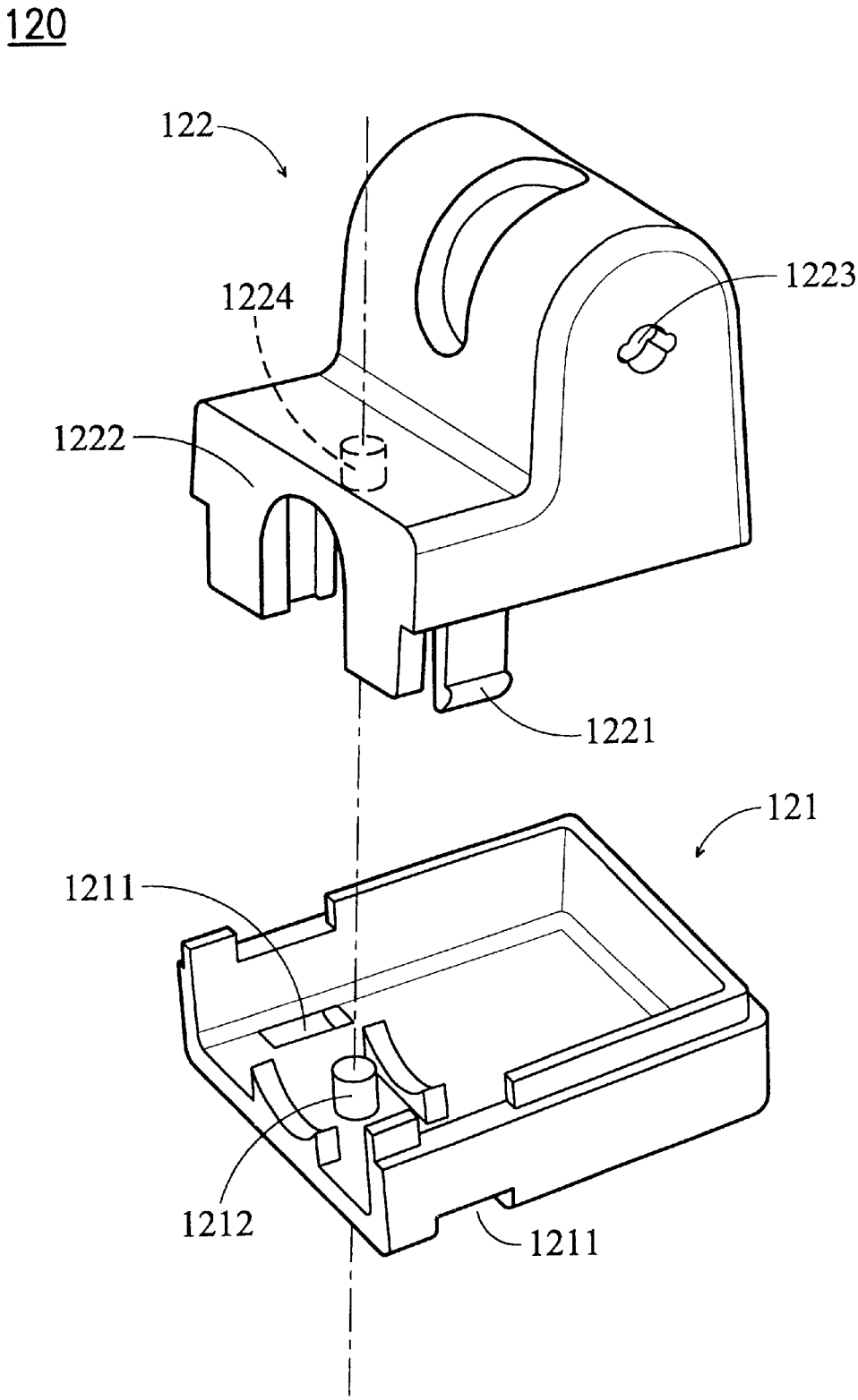
FIG. 3*b* is a three dimensional diagram depicting an intermediate assembly in FIG. 2.
Figure 3C:
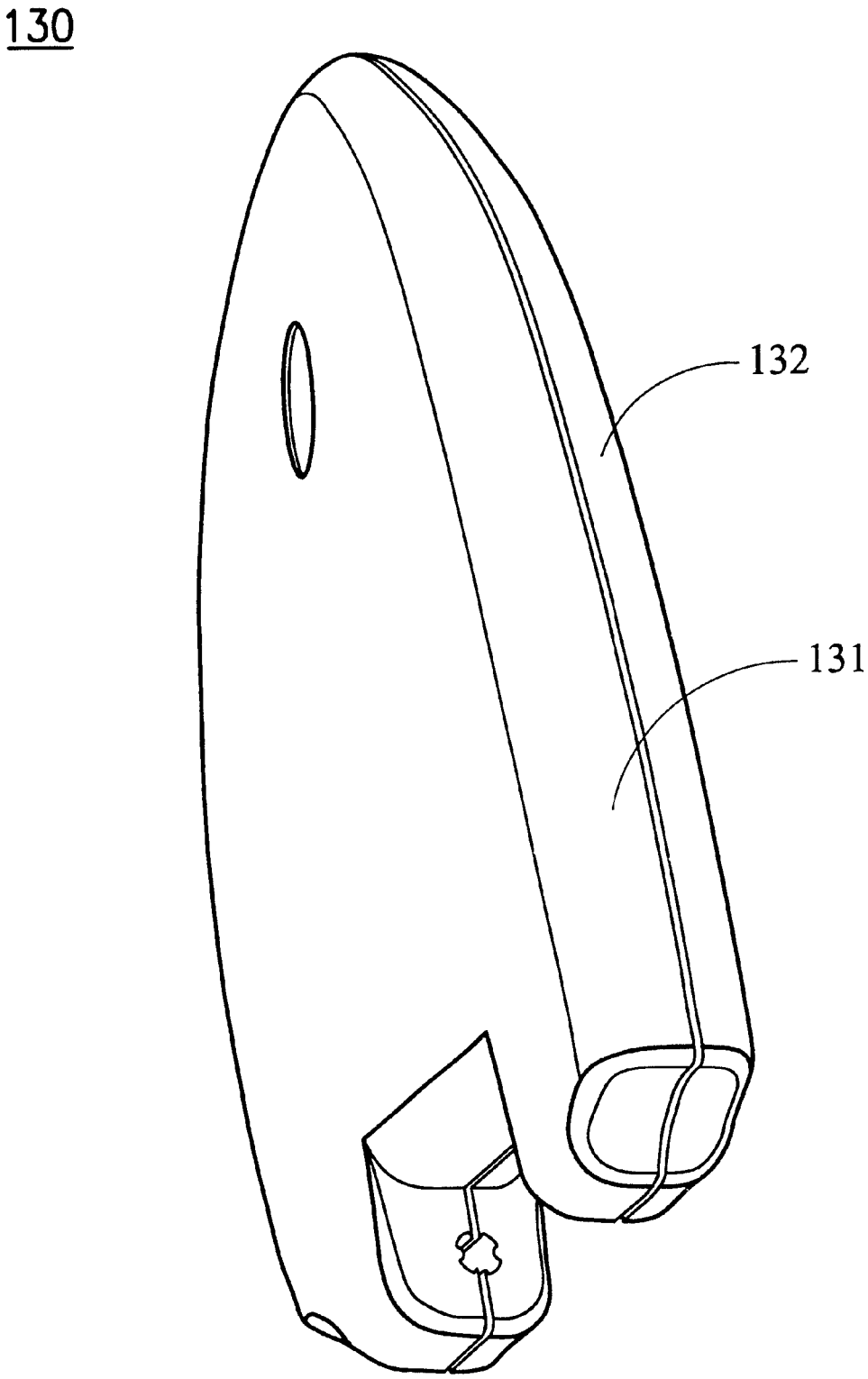
FIG. 3*c* is a three dimensional diagram depicting an antenna in FIG. 2.
Figure 3D:
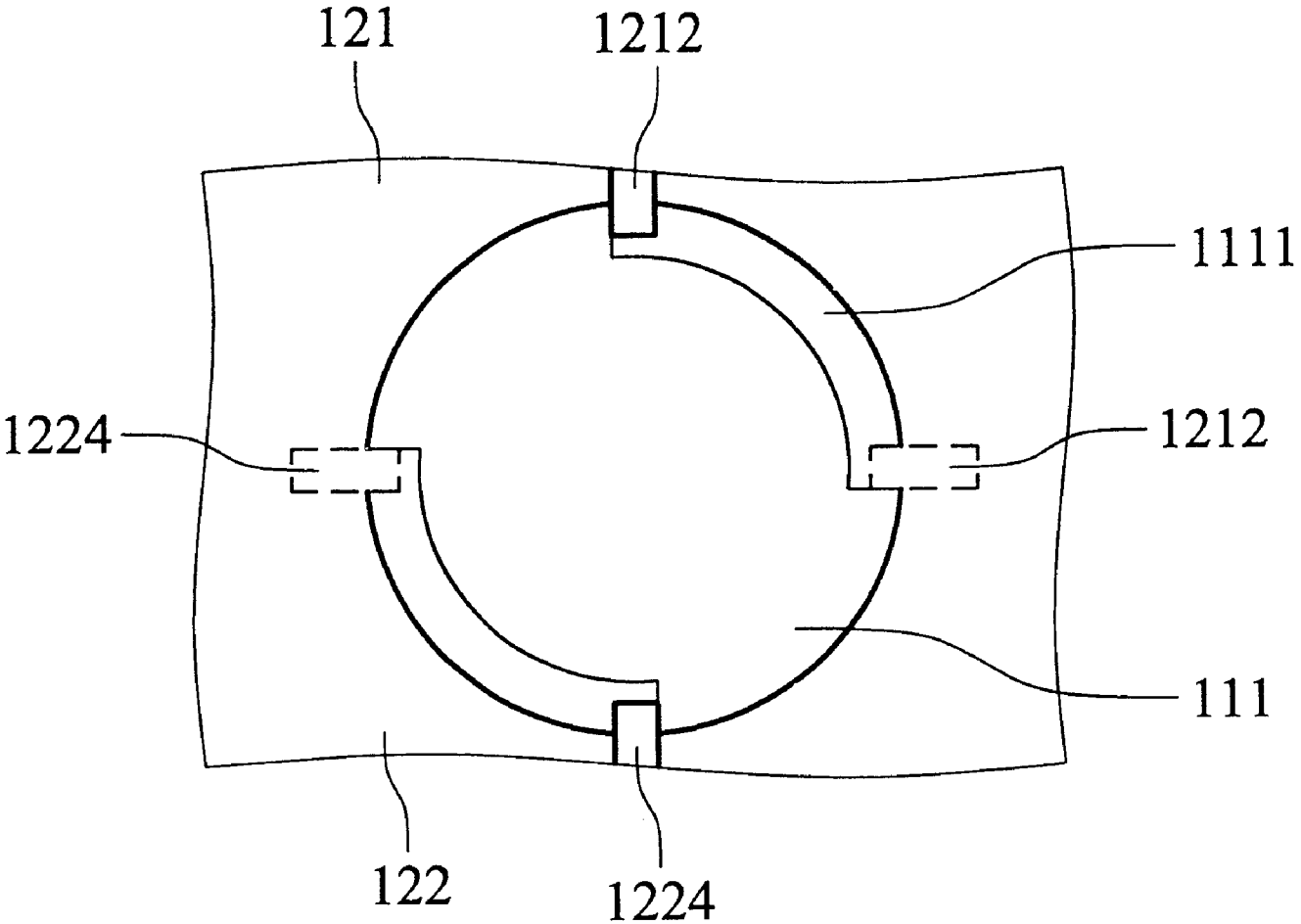
FIG. 3*d* is a schematic view depicting the relationship between grooves of the connecting assembly and stoppers of the intermediate assembly in FIG. 2.

The connecting assembly 110 is connected with the connectors 21, 31 of the electronic devices 20, 30, as shown in FIG. 1*b* and FIG. 1*c,* in a detachable manner. As shown in FIG. 3*a,* the connecting assembly 110 is provided with a rotating member 111 at one end. The rotating member 111 is disposed in the intermediate assembly 120 in a rotatable manner. The rotating member 111 is provided with two grooves 1111, and each of the grooves 1111 is one quarter of the circumference of the rotating member 111, as shown in FIG. 3*d.* In addition, the connecting assembly 110 is provided with a connector 112 at the other end. In this embodiment, the connector 112 is a USB port; therefore, the connectors 21, 31 are USB ports. However, the type of the connector is not limited.

The intermediate assembly 120 connects with the connecting assembly 110 in a rotatable manner. As shown in FIG. 3*b,* the intermediate assembly 120 comprises a first base 121 and a second base 122. The first base 121 holds the rotating member 111 of the connecting assembly 110, and is provided with two first through holes 1211 and a first stopper 1212. The first stopper 1212 is integrally formed on the first base 121, and is fitted into the groove 1111 of the rotating member 111 when the rotating member 111 of the connecting assembly 110 is located in the intermediate assembly 120. As shown in FIG. 3*d,* since the first stopper 1212 is fitted into the groove 1111, there is a damping effect between the first stopper 1212 and the groove 1111 while the first stopper 1212 can move in the groove 1111 without interference.

The second base 122 is provided with two hooks 1221, a locating member 1222, two second through holes 1223, and a second stopper 1224. Each of the hooks 1221 corresponds to the first through hole 1211 of the first base 121 respectively. Thus, the second base 122 is combined with the first base 121 by the hooks 1221 engaging with the first through holes 1211. In addition, the second base 122 is disposed on the first base 121 in a manner such that the rotating member 111 of the connecting assembly 110 is disposed between the first base 121 and the second base 122 in a rotatable manner. The locating member 1222, abutting with the rotating member 111 of the connecting assembly 110, locates the rotating member 111 in the intermediate assembly 120. The second through holes 1223 are used for the shaft 140 to pass through. The second stopper 1224 is integrally formed on the second base 122, and is fitted into the groove 1111 of the rotating member 111 when the rotating member 111 of the connecting assembly 110 is located in the intermediate assembly 120. As shown in FIG. 3*d,* since the second stopper 1224 is fitted into the groove 1111, there is a damping effect between the second stopper 1224 and the groove 1111 while the second stopper 1224 can move in the groove 1111 without interference.

As stated above, when the rotating member 111 of the connecting assembly 110 is located between the first base 121 and the second base 122 of the intermediate assembly 120, the first stopper 1212 and the second stopper 1224 are fitted into the grooves 1111 of the rotating member 111 so that the rotating member 111 rotates within a predetermined range as shown in FIG. 3*d.* Specifically, since each of the grooves 1111 is one quarter of the circumference of the rotating member 111, the rotating member 111 can only rotate about an angle of 90 degrees in the intermediate assembly 120. Thus, the wire (not shown) between the connecting assembly 110 and the intermediate assembly 120 is prevented from breaking due to over rotation.

The antenna 130 is provided with a wireless communication device (not shown) therein, and comprises a first case 131 and a second case 132. By means of the shaft 140, the antenna 130 is connected with the intermediate assembly 120 in a rotatable manner. That is, the shaft 140 connects the intermediate assembly 120 and the antenna 130.

It is understood that wires, connecting the connecting assembly 110, the intermediate assembly 120, and the antenna 130, are disposed inside the connecting assembly 110, the intermediate assembly 120, and the antenna 130. Thus, the connecting assembly 110 is electrically coupled to the antenna 130 through the intermediate assembly 120.

The assembly of the wireless adapter 100 is described as follows.

The rotating member 111 of the connecting assembly 110 is disposed on the first base 121 while the first stopper 1212 of the first base 121 is fitted into one groove 1111 of the rotating member 111. After the hooks 1221 engage with the first through holes 1211 to combine the first base 121 and the second base 122, the second stopper 1224 of the second base 122 is fitted into the other groove 1111 of the rotating member 111. Then, the shaft 140 passes through the second through holes 1223 of the second base 122, and the first case 131 and the second case 132 clamp the shaft 140 to complete the antenna 130 and complete the whole wireless adapter 100.

It is noted that the size of the grooves 1111 is limited to one quarter of the circumference of the rotating member 111 as long as the wire is not broken. Furthermore, the amount of the groove and the stopper is also not limited.

In addition, it is understood that the first case 131 and second case 132 can be combined by screws; however, it is not limited.

Figure 4A:
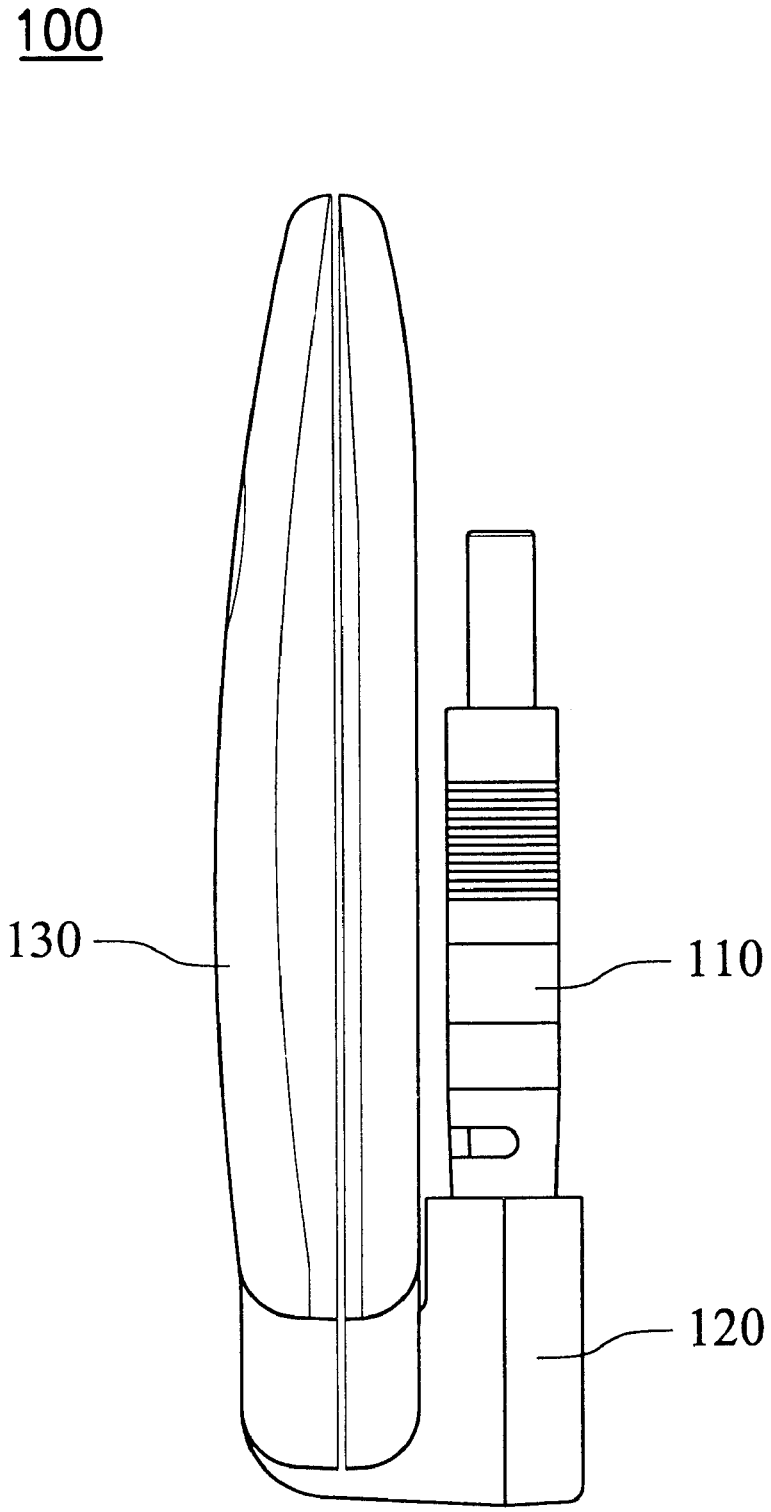
FIG. 4*a* is a side view depicting the wireless adapter in FIG. 2, wherein the antenna is parallel to the connecting assembly.
Figure 4B:
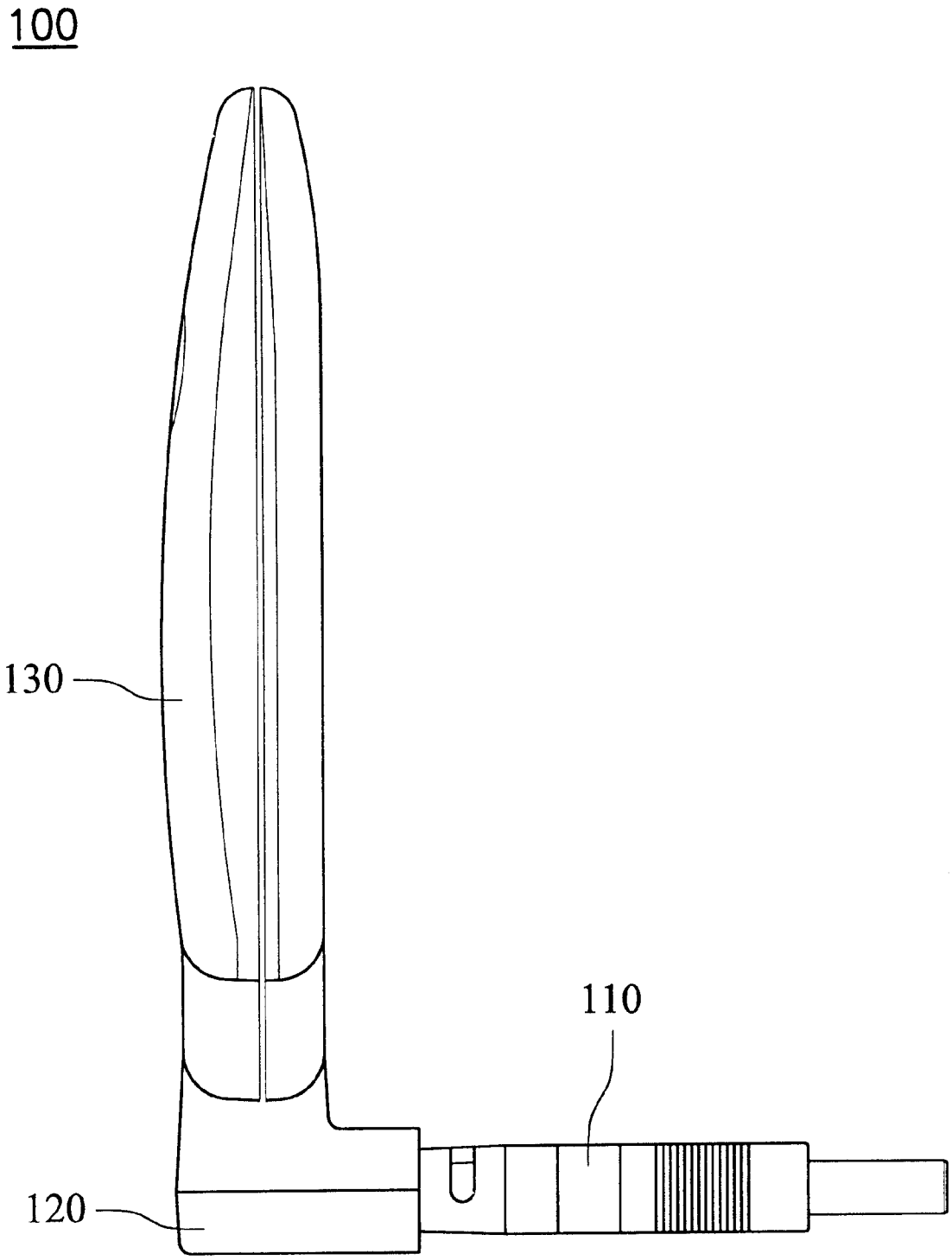
FIG. 4*b* is a side view depicting the wireless adapter in FIG. 2, wherein the antenna is perpendicular to the connecting assembly.
Figure 4C:
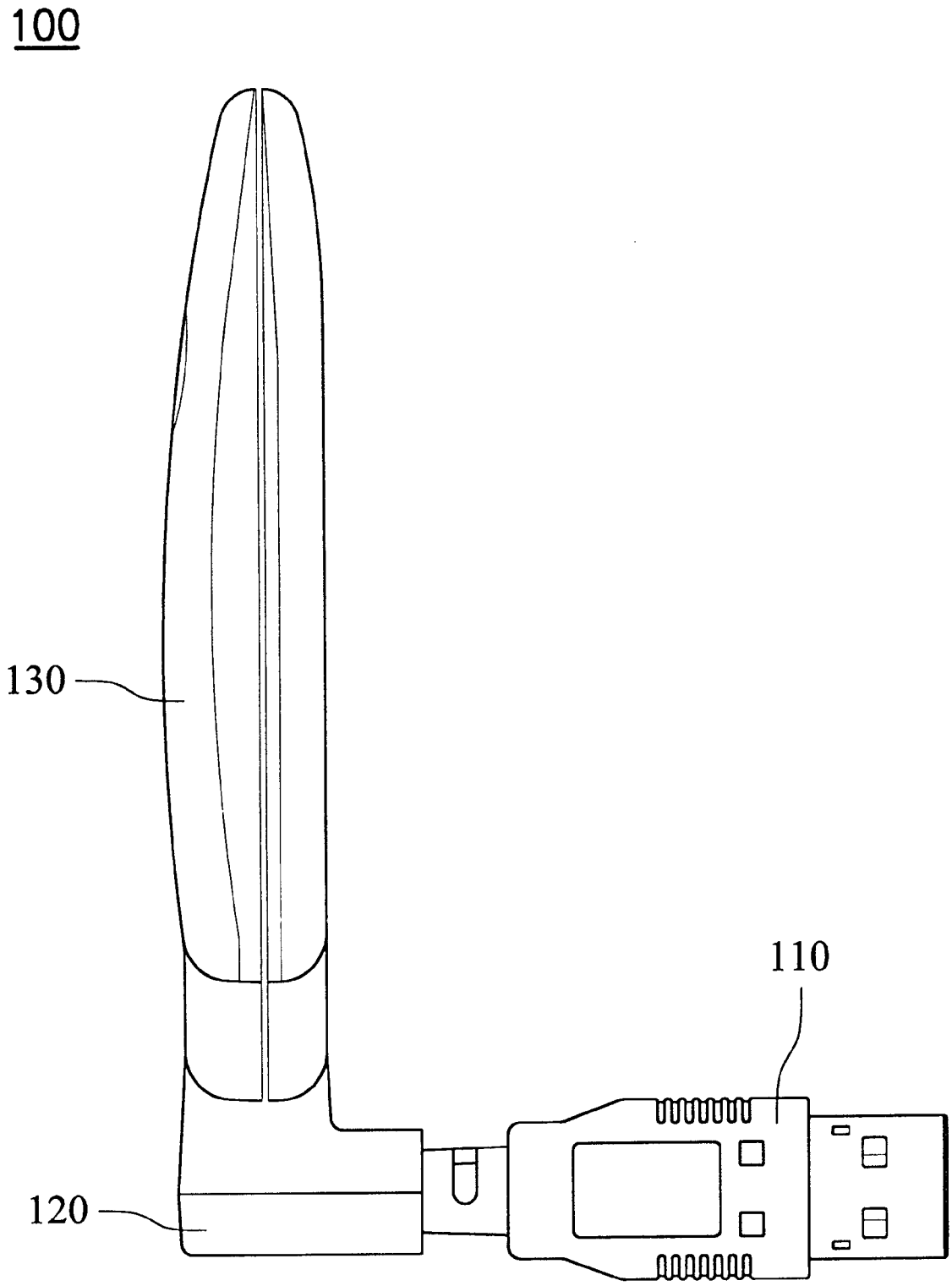
FIG. 4*c* is a side view depicting the wireless adapter in FIG. 2, wherein the connecting assembly rotates around the intermediate assembly at an angle of 90 degrees.

When the wireless adapter 100 is not used, it can be folded, as shown in FIG. 4*a,* to be convenient to carry. At this time, the antenna 130 is parallel to the connecting assembly 110. When the wireless adapter 100 is applied for the electronic device 20 as shown in FIG. 1*b,* the antenna 130 rotates at an angle of 90 degrees relative to the intermediate assembly 120, as shown in FIG. 4*b*. When the wireless adapter 100 is applied for the electronic device 30 as shown in FIG. 1*c,* unless the antenna 130 rotates at an angle of 90 degrees relative to the intermediate assembly 120, the connecting assembly 110 also rotates at an angle of 90 degrees relative to the intermediate assembly 120, as shown in FIG. 4*c*.

As stated above, no matter at which angle of the connector of the electronic device, the wireless adapter can be conveniently applied without affecting its communication quality.

While the invention has been particularly shown and described with reference to a preferred embodiment, it will be readily appreciated by those of ordinary skill in the art that various changes and modifications maybe made without departing from the spirit and scope of the invention. It is intended that the claims be interpreted to cover the disclosed embodiment, those alternatives which have been discussed above, and all equivalents thereto.

What is claimed is:

1. A wireless adapter, adapted for an electronic device having a connector, comprising:

a connecting assembly connecting with the connector in a detachable manner;

an intermediate assembly connecting with the connecting assembly in a rotatable manner; and an antenna connecting with the intermediate assembly in a rotatable manner;

wherein the connecting assembly is provided with a rotating member disposed in the intermediate assembly in a rotatable manner;

wherein the rotating member is provided with at least one groove, and the intermediate assembly is provided with at least one stopper, whereby the stopper is fitted into the groove when the rotating member is located in the intermediate assembly so that the rotating member rotates within a predetermined range.

2. The wireless adapter as claimed in claim 1, wherein the intermediate assembly is provided with a locating member, abutting with the rotating member, for locating the rotating member in the intermediate assembly.

3. The wireless adapter as claimed in claim 1, wherein the connecting assembly is electrically coupled to the antenna through the intermediate assembly.

4. The wireless adapter as claimed in claim 1, wherein the connector is a USB port, and the connecting assembly is a USB plug.

5. The wireless adapter as claimed in claim 1, wherein the intermediate assembly comprises:

a first base for holding the connecting assembly; and a second base disposed on the first base in a manner such that the connecting assembly Is disposed between the first base and the second base in a rotatable manner, wherein the second base connects with the antenna in a rotatable manner.

6. The wireless adapter as claimed in claim 5, wherein the first base is provided with at least one first through hole, and the second base is provided with at least one hook corresponding to the first through hole, whereby the second base is combined with the first base by the hook engaging with the first through hole.

7. The wireless adapter as claimed in claim 1, further comprising:

a shaft for connecting the intermediate assembly and the antenna.

8. The wireless adapter as claimed in claim 7, wherein the intermediate assembly is provided with at least one second through hole for the shaft passing through.

9. A wireless adapter comprising:

a connecting assembly;

an intermediate assembly connecting with the connecting assembly in a rotatable manner; and an antenna connecting with the intermediate assembly in a rotatable manner, wherein the connecting assembly is provided with a rotating member disposed in the intermediate assembly in a rotatable manner;

wherein the rotating member is provided with at least one groove, and the intermediate assembly is provided with at least one stopper, whereby the stopper is fitted into the groove when the rotating member is located in the intermediate assembly so that the rotating member rotates within a predetermined range.

10. The wireless adapter as claimed in claim 9, wherein the intermediate assembly is provided with a locating member, abutting with the rotating member, for locating the rotating member in the intermediate assembly.

11. The wireless adapter as claimed in claim 9, wherein the connecting assembly is electrically coupled to the antenna through the intermediate assembly.

12. The wireless adapter as claimed in claim 9, wherein the connecting assembly is a USB plug.

13. The wireless adapter as claimed in claim 9, wherein the intermediate assembly comprises:

a first base for holding the connecting assembly; and a second base disposed on the first base in a manner such that the connecting assembly is disposed between the first base and the second base in a rotatable manner, wherein the second base connects with the antenna in a rotatable manner.

14. The wireless adapter as claimed in claim 13, wherein the first base is provided with at least one first through hole, and the second base is provided with at least one hook corresponding to the first through hole, whereby the second base is combined with the first base by the hook engaging with the first through hole.

15. The wireless adapter as claimed in claim 9, further comprising:

a shaft for connecting the intermediate assembly and the antenna.

16. The wireless adapter as claimed in claim 15, wherein the intermediate assembly is provided with at least one second through hole for the shaft to pass through.

* * * * *